US009551945B2

(12) United States Patent
Kawabata et al.

(10) Patent No.: US 9,551,945 B2
(45) Date of Patent: Jan. 24, 2017

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Yukimi Kawabata, Kanagawa (JP); Kazuyuki Tada, Kanagawa (JP); Jiro Korenaga, Kanagawa (JP); Yasuhiro Niida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/812,555

(22) Filed: Jul. 29, 2015

(65) Prior Publication Data

US 2016/0246190 A1 Aug. 25, 2016

(30) Foreign Application Priority Data

Feb. 19, 2015 (JP) ..... 2015-031019

(51) Int. Cl.
*G03G 5/04* (2006.01)
*G03G 5/043* (2006.01)

(52) U.S. Cl.
CPC ..... *G03G 5/043* (2013.01)

(58) Field of Classification Search
CPC ..... G03G 5/02; G03G 5/06; G03G 5/0664; G03G 5/0696; G03G 5/04
See application file for complete search history.

(56) References Cited

U.S. PATENT DOCUMENTS

2009/0317733 A1* 12/2009 Okura ..... G03G 5/0605 430/56
2013/0288169 A1 10/2013 Yamano et al.
2014/0093280 A1* 4/2014 Kimoto ..... G03G 5/043 399/159
2014/0093816 A1* 4/2014 Mizuta ..... G03G 5/043 430/56
2014/0093817 A1* 4/2014 Mizuta ..... G03G 5/043 430/56

(Continued)

FOREIGN PATENT DOCUMENTS

JP 2002-139851 A 5/2002
JP 2012-247497 A 12/2012

(Continued)

*Primary Examiner* — Hoa V Le
(74) *Attorney, Agent, or Firm* — Oliff PLC

(57) ABSTRACT

An electrophotographic photoreceptor includes a conductive substrate, and a single-layer type photosensitive layer that contains a binder resin, a charge generating material, a hole transporting material, and an electron transporting material, wherein a content of the charge generating material in the photosensitive layer is 0.5% by weight or more and less than 2.0% by weight and the charge generating material satisfies expression (1): $30 \leq a/b$, wherein a represents the number of the charge generating materials per unit cross-sectional area in a region ranging from the surface side of the film thickness of the photosensitive layer to a point corresponding to ⅓, and b represents the number of the charge generating materials per unit cross-sectional area in a region ranging from the conductive substrate side of the film thickness of the photosensitive layer to a position corresponding to ⅔, provided that a case where b is 0 is included.

8 Claims, 5 Drawing Sheets

(56) References Cited

U.S. PATENT DOCUMENTS

| | | | | |
|---|---|---|---|---|
| 2014/0120464 | A1* | 5/2014 | Iwashita | G03G 15/75<br>430/56 |
| 2014/0356773 | A1* | 12/2014 | Azuma | G03G 5/047<br>430/59.6 |

FOREIGN PATENT DOCUMENTS

| | | | |
|---|---|---|---|
| JP | 2012-247498 | A | 12/2012 |
| JP | 2012-247614 | A | 12/2012 |
| JP | 2013-231867 | A | 11/2013 |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-031019 filed Feb. 19, 2015.

BACKGROUND

1. Technical Field

The invention relates to an electrophotographic photoreceptor, a process cartridge, and an image forming apparatus.

2. Related Art

In an image forming apparatus in an electrophotographic system in the related art, a toner image formed on the surface of an electrophotographic photoreceptor is transferred to a recording medium through charging, electrostatic latent image-forming, developing, and transfer processes.

SUMMARY

According to an aspect of the invention, there is provided an electrophotographic photoreceptor including:

a conductive substrate; and a single-layer type photosensitive layer that is provided on the conductive substrate and contains a binder resin, a charge generating material, a hole transporting material, and an electron transporting material, wherein a content of the charge generating material in the photosensitive layer is 0.5% by weight or more and less than 2.0% by weight and the charge generating material satisfies the following expression (1) with respect to a distribution of the charge generating material in the film thickness direction of the photosensitive layer:

$$30 \leq a/b \qquad \text{Expression (1)}$$

wherein a represents the number of the charge generating materials per unit cross-sectional area in a region ranging from the surface side of the film thickness of the photosensitive layer to a point corresponding to ⅓, and b represents the number of the charge generating materials per unit cross-sectional area in a region ranging from the conductive substrate side of the film thickness of the photosensitive layer to a position corresponding to ⅔, provided that a case where b is 0 is also included.

BRIEF DESCRIPTION OF THE DRAWINGS

Exemplary embodiments of the present invention will be described in detail based on the following figures, wherein.

DETAILED DESCRIPTION

Figure 1:
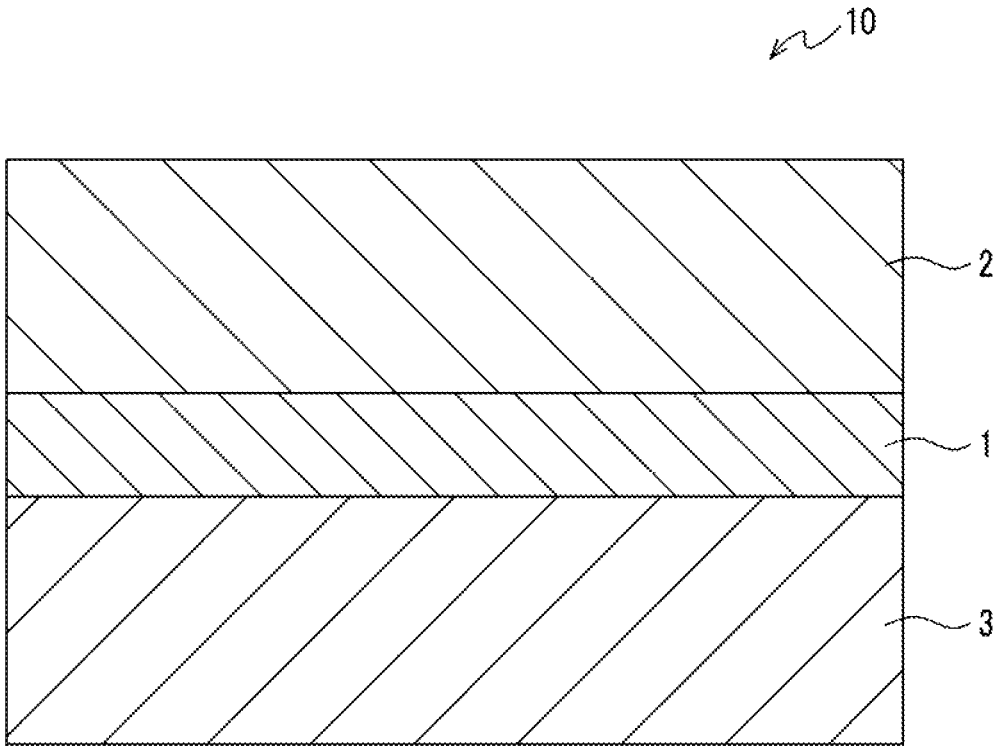
FIG. 1 is a schematic partial cross-sectional view showing an electrophotographic photoreceptor according to an exemplary embodiment.

An exemplary embodiment which is an example of the invention will be described in detail below.

Electrophotographic Photoreceptor

An electrophotographic photoreceptor according to the present exemplary embodiment (hereinafter sometimes referred to as a "photoreceptor") is a positively charged organic photoreceptor (hereinafter sometimes referred to as a "single-layer type photoreceptor"), which is provided with a conductive substrate, and a single-layer type photosensitive layer on the conductive substrate.

Further, the single-layer type photosensitive layer (hereinafter sometimes simply referred to as a "photosensitive layer") includes a binder resin, charge generating materials, hole transporting materials, and electron transporting materials. Further, the charge generating materials have a content in the photosensitive layer of 0.5% by weight or more and less than 2.0% by weight, and a distribution configured to satisfy the following formula (1) in the film thickness direction.

$$30 \leq a/b \qquad \text{Formula (1)}$$

In the formula (1), a represents the number of the charge generating materials per unit of cross-sectional area in a region ranging from the surface side of the film thickness of the photosensitive layer to a point corresponding to ⅓, and b represents the number of the charge generating materials per unit cross-sectional area in a region ranging from the conductive substrate side of the film thickness of the photosensitive layer to a position corresponding to ⅔, provided that a case where b is 0 is included.

Furthermore, the single-layer type photosensitive layer is a photosensitive layer having charge generating capabilities as well as hole transporting properties and electron transporting properties.

In the electrophotographic photoreceptor according to the present exemplary embodiment, the "the content in the photosensitive layer" of the charge generating materials represents a content with respect to the entire photosensitive layer.

A "region ranging from a surface side of a film thickness of the photosensitive layer to a point corresponding to ⅓ of the film thickness" represents a region ranging from the outermost surface of the photosensitive layer toward to a position corresponding to ⅓ of the film thickness of the photosensitive layer from the conductive substrate.

A "region ranging from a conductive substrate side of a film thickness of the photosensitive layer to a position corresponding to ⅔ of the film thickness" represents a region ranging from the conductive substrate side toward the outermost surface side in the film thickness of the photosensitive layer to a position corresponding to ⅔ of the film thickness, that is, a region excluding a region ranging from the outermost surface side of the photosensitive layer toward the conductive substrate to a position corresponding to ⅓ of the film thickness.

The "number of charge generating materials per unit cross-sectional area" represents the number of charge generating materials present in a cross-section when the cross-section of the film thickness of the photosensitive layer is observed, expressed in a unit of the number of the materials per square micrometers ($\mu m^2$).

Here, in the related art, a single-layer type photoreceptor is preferable as an electrophotographic photoreceptor from the viewpoints of production cost and the like.

The single-layer type photoreceptor is configured to include charge generating materials, hole transporting materials, and electron transporting materials in the single-layer type photosensitive layer, and performs a charging function and a photosensitivity-expressing function in the same layer. On the other hand, an organic photoreceptor having a laminate-type photosensitive layer (hereinafter referred to as a "laminate-type photoreceptor") may be specialized to perform a charging function and a photosensitivity-expressing function separately according to the functions. Thus, in principle, it is difficult to obtain characteristics that are at least equivalent to those of the laminate-type photoreceptor in terms of chargeability and photosensitivity.

On the contrary, with the electrophotographic photoreceptor according to the present exemplary embodiment, it is possible to obtain an electrophotographic photoreceptor having high chargeability and high sensitivity by adopting the configurations above, that is, by controlling the distribution of charge generating materials in the film thickness direction of the photosensitive layer. The reason therefor is not clear, but is presumed to be as follows.

In the single-layer type photoreceptor, for the chargeability, it is preferable that excess charges (thermally excited carriers) are not generated in the photosensitive layer under a dark condition. In order to prevent the generation of thermally excited carriers in the photosensitive layer, it becomes easy to secure the prevention by reducing the content of the charge generating materials.

A sufficient amount of charges generated, hole transportability, and electron transportability are required so as to obtain photosensitivity. For example, when the content of the charge generating materials is increased (for example, to 2.0% by weight or more), the photosensitivity is easily improved. However, when the content of the charge generating materials is increased too much, the chargeability is easily decreased, and as a result, a small content of the charge generating materials is preferable. On the other hand, when the content of the charge generating materials is decreased, too much the photosensitivity is easily reduced. For example, in the case where the content of the charge generating materials in the photosensitive layer is 0.5% by weight or more and less than 2.0% by weight, it is difficult to obtain a photoreceptor having both high chargeability and high sensitivity.

Since the transportability of generally known electron transporting materials having the highest electron transportability is one over several tens times the hole transportability of the hole transporting material, the electron transportability is lower than the hole transportability in the photosensitive layer. As a result, it is considered that it is desirable to shorten the transporting distance of electrons in order to further improve the performance of the photosensitivity in the single-layer type photoreceptor.

If the photosensitive layer is irradiated with light in the single-layer type photoreceptor, the charge generating materials absorb light to generate charges, and therefore, the charges are more easily generated in the region on the surface side of the photosensitive layer. Further, if the charges are easily generated, the transporting distance of the electrons may be decreased. It is considered that when the transporting distance of the electrons is decreased, the electron transportability is improved and the photosensitivity may thus be improved.

As a result, in the electrophotographic photoreceptor according to the present exemplary embodiment, the photosensitivity-expressing function of the charge generating materials may be more effectively exerted by making the charge generating materials unevenly distributed in the region or the surface side of the single-layer type photosensitive layer. That is, it is presumed that an electrophotographic photoreceptor having high chargeability and high sensitivity is obtained even when the content of the charge generating materials in the entire single-layer type photosensitive layer is 0.5% by weight or more and less than 2.0% by weight, by increasing the content of the charge generating materials included in the single-layer type photosensitive layer in a region ranging from the surface side of the photosensitive layer to a position corresponding to ⅓.

In addition, since an electrophotographic photoreceptor having high chargeability and high sensitivity may be obtained by the electrophotographic photoreceptor according to the present exemplary embodiment, a change in the electrical characteristics may be prevented even with long-term use.

Hereinbelow, the electrophotographic photoreceptor according to the present exemplary embodiment will be described in detail with reference to the following figures.

FIG. 1 schematically shows a cross-section of a part of an electrophotographic photoreceptor 10 according to the present exemplary embodiment.

The electrophotographic photoreceptor 10 shown in FIG. 1 is configured to be provided with, for example, a conductive and then an undercoat layer 1 and a single-layer type photosensitive layer 2 in this order on the conductive substrate 3.

Furthermore, the undercoat layer 1 is a layer provided, as desired. That is, the single-layer type photosensitive layer 2 may be provided directly on the conductive substrate 3 or provided thereon through the undercoat layer 1.

Furthermore, other layers may also be provided. Specifically, for example, a protective layer may be provided on the single-layer type photosensitive layer 2, as desired.

Hereinbelow, the respective components of the electrophotographic photoreceptor according to the present exemplary embodiment will be described in detail. Further, the explanations will be made with omission of the symbols.

Conductive Substrate

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is less than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm o prevent interference fringes which are formed when irradiated with laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

Examples of the method for surface roughening include wet honing in which an abrasive suspended in water is blown onto a conductive substrate, centerless grinding in which a support is continuously ground by pressing a conductive substrate onto a rotating grind stone, and anodic oxidation treatment.

Other examples of the method for surface roughening include a method for surface roughening by forming a layer of a resin in which conductive or semiconductive particles are dispersed on the surface of a conductive substrate so that the surface roughening is achieved by the particles dispersed in the layer, without roughing the surface of the conductive substrate.

In the surface roughening treatment by anodic oxidation, an oxide film is formed on the surface of a conductive substrate by anodic oxidation in which a metal (for example, aluminum) conductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be prevented.

The conductive substrate may be subjected to a treatment with an acidic aqueous solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binder resin.

Examples of the inorganic particles include inorganic particles having powder resistance (volume resistivity) of about $10^2$ Ωcm to $10^{11}$ Ωcm.

Among these, as the inorganic particles having the resistance values above, metal oxide particles such as tin oxide particles, titanium oxide particles, zinc oxide particles, and zirconium oxide particles are preferable, and zinc oxide particles are more preferable.

The specific surface area of the inorganic particles as measured by a BET method is, for example, preferably 10 $m^2/g$ or more.

The volume average particle diameter of the inorganic particles is, for example, preferably from 50 nm to 2,000 nm (preferably from 60 nm to 1,000 nm).

The content of the inorganic particles is, for example, preferably from 10% by weight to 80% by weight, and more preferably from 40% by weight to 80% by weight, based on the binder resin.

The inorganic particles may be the ones which have been subjected to a surface treatment. The inorganic particles which have been subjected to different surface treatments or have different particle diameters may be used in combination of two or more kinds.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyl triethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more kinds thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either a dry method or a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking properties.

Examples of the electron acceptive compound include electron transporting materials including, for example, quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1, 3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, aminoanthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The addition or spraying of the electron acceptive compound is preferably carried out at a temperature no higher than the boiling point of the solvent. After the addition or spraying of the electron acceptive compound, the inorganic particles may further be subjected to baking at a temperature of 100° C. or higher. The baking may be carried out at any temperature and timing without limitation, by which desired electrophotographic characteristics may be obtained.

The wet method is a method for attaching an electron acceptive compound to the surface of the inorganic particles, in which the inorganic particles are dispersed in a solvent by means of stirring, an ultrasonic wave, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and timing without limitation, in which desired electrophotographic characteristics may be obtained. In the wet method, the moisture contained in the inorganic particles may be removed prior to adding the surface treatment agent, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound is, for example, preferably from 0.01% by weight to 20% by weight, and more preferably from 0.01% by weight to 10% by weight, based on the inorganic particles.

Examples of the binder resin used in the undercoat layer include known materials including, for example, known polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, unsaturated polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binder resin used in the undercoat layer include charge transporting resins having charge transporting groups, and conductive resins (for example, polyaniline).

Among these, as the binder resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins with curing agents are suitable.

In the case where these binder resins are used in combination of two or more kinds thereof, the mixing ratio is set as appropriate.

Various additives may be used for the undercoat layer to improve electrical characteristics, environmental stability, or image quality.

Examples of the additives include known materials such as the polycyclic condensed type or azo type of electron transporting pigments, zirconium chelate compounds, titanium chelate compounds, aluminum chelate compounds, titanium alkoxide compounds, organic titanium compounds, and silane coupling agents. A silane coupling agent, which is used for the surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropytrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used alone, or as a mixture or a polycondensate of two or more kinds thereof.

The Vickers hardness of the undercoat layer is preferably 35 or more.

The surface roughness of the undercoat layer (ten point height of irregularities) is adjusted in the range of $(1/(4n))\lambda$ to $(1/2)\lambda$, in which $\lambda$ represents the wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and cross-linked polymethyl methacrylate resin particles. In addition, the surface of the undercoat layer may be polished in order to adjust the surface roughness. Examples of the polishing method include buffing, grinding, a sandblasting treatment, wet honing, and a grinding treatment.

The formation of the undercoat layer is not particularly limited, and known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for preparing the coating liquid for forming the undercoat layer include alcohol solvents, aromatic hydrocarbon solvents, hydrocarbon halide solvents, ketone solvents, ketone alcohol solvents, ether solvents, and ester solvents.

Specific examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

Furthermore, as a method for coating the coating liquid for forming an undercoat layer onto a conductive substrate include ordinary methods such as a blade coating method, a wire bar coating method, a spraying method, a dipping coating method, a bead coating method, an air knife coating method, and a curtain coating method.

The film thickness of the undercoat layer is set to a range of, for example, preferably 15 μm or more, and more preferably from 20 μm to 50 μm.

Intermediate Layer

Although not shown in the figures, an intermediate layer may be provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organometallic compound. Examples of the organometallic compound used in the intermediate layer include organometallic compounds containing a metal atom such as zirconium, titanium, aluminum, manganese, and silicon.

These compounds used in the intermediate layer may be used alone or as a mixture or a polycondensate of plural compounds.

Among these, layers containing organometallic compounds containing a zirconium atom or a silicon atom are preferable.

The formation of the intermediate layer is not particularly limited, and known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, ordinary methods such as a dipping coating method, an extrusion coating method, a wire bar coating method, a spraying method, a blade coating method, a knife coating method, and a curtain coating method are used.

The film thickness of the intermediate layer is set to, for example, preferably a range of 0.1 μm to 3 μm. Further, the intermediate layer may be used as an undercoat layer.

Single-Layer Type Photosensitive Layer

The single-layer type photosensitive layer of the present exemplary embodiment is unevenly distributed in a region on the surface side in the film thickness direction of the photosensitive layer in the charge generating materials included in the single-layer type photosensitive layer. Further, it is configured to have formula indicating the distribution of charge generating materials in the film thickness direction of the photosensitive layer satisfying the relationship of $30 \leq a/b$.

Here, in the single-layer type photosensitive layer of the present exemplary embodiment, a clear interface is not formed in the boundary between a region on the surface side having a large amount of the charge generating materials present thereon and a region on the conductive substrate side having a small amount of the charge generating materials present thereon. Further, in the case where b is 0, there exist a region on the surface side having the charge generating materials present thereon and a region on the conductive substrate side having the charge generating materials not present thereon. Also in this case, a clear interface is not formed in the boundary between the regions.

Incidentally, in a generally known laminate-type photosensitive layer, a charge generating layer containing charge generating materials and a charge transporting layer not containing charge generating materials are formed, and a clear interface is formed in the boundary between both the layers. Further, since a binder resin used in the charge generating layer is different from a binder resin used in the charge transporting layer in many cases, both the layers are clearly distinguishable.

On the other hand, in the single-layer type photosensitive layer of the present exemplary embodiment, even in the case where b is 0 as described above, the boundary between a region on the surface side having charge generating materials thereon and a region on the conductive substrate side having charge generating materials not present thereon is ambiguous. Therefore, the single-layer type photosensitive layer of the present exemplary embodiment is clearly distinguishable from a laminate-type photosensitive layer in the related art.

The single-layer type photosensitive layer is not particularly limited in terms of the embodiment as long as it is configured to satisfy a relationship of $30 \leq a/b$. Examples thereof include the following embodiments.

In the case where b is 0, the embodiments include an embodiment in which charge generating materials are present only in a region ranging from the surface side of the photosensitive layer to a position corresponding to ¼ and the charge generating materials are not present in a region ranging from the conductive substrate side of the photosensitive layer to a position corresponding to ¾ of the film thickness; an embodiment in which charge generating materials are present only in a region ranging from the surface side of the photosensitive layer to a position corresponding to ⅓ and the charge generating materials are not present in a region ranging from the conductive substrate side of the photosensitive layer to a position corresponding to ⅔ of the film thickness; and an embodiment in which charge generating materials are present only in a region ranging from the surface side of the photosensitive layer to a position corresponding to ½ and the charge generating materials are not present in a region ranging from the conductive substrate side of the photosensitive layer to a position corresponding to ½ of the film thickness.

In the case where b is more than 0 (that is, the case where the charge generating materials are present throughout the photosensitive layer), the embodiments include an embodiment in which a large amount of charge generating materials are present in a region ranging from the surface side of the photosensitive layer to a position corresponding to ½ and a smaller amount of the charge generating materials are present in a region ranging from the conductive substrate side of the photosensitive layer to a position corresponding to ½ of the film thickness than in a region ranging from the surface side to a position corresponding to ½; an embodiment in which a large amount of charge generating materials are present in a region ranging from the surface side of the photosensitive layer to a position corresponding to ⅓ and a smaller amount of the charge generating materials are present in a region ranging from the conductive substrate side of the photosensitive layer to a position corresponding to ⅔ of the film thickness than in a region ranging from the surface side to a position corresponding to ⅓; and an embodiment where a large amount of charge generating materials are present in a region ranging from the surface side of the photosensitive layer to a position corresponding to ⅓ and a stepwise decreasing amount of charge generating materials are present toward the conductive substrate side in the film thickness direction of the photosensitive layer.

Among these embodiments, the embodiments where b is 0 are preferable from the viewpoint that the photosensitivity-expressing function of the charge generating materials may be more effectively exerted.

With regard to a/b, which is a formula indicating the distribution of charge generating materials in the film thickness direction of the photosensitive layer, a and b are measured by carrying out an image treatment with an image obtained with a scanning electron microscope (SEM), and a/b is calculated from the measurement results.

Specifically, the photosensitive layer is peeled from a photoreceptor to be measured, and a small piece is cut therefrom, embedded in an epoxy resin, and solidified. A section thereof is prepared using a microtome, and used as a sample for measurements of a and b. Further, three positions of the sample to be measured are observed using JSM-6700F/JED-2300F (manufactured by JEOL Ltd.) as an SEM apparatus, and a and b are measured (a and b are calculated as an average of three values at three positions (hereinafter, referred to as "n3 average")).

Furthermore, the SEM image is observed by setting a distance in the direction parallel to the surface of the conductive substrate of the photosensitive layer to a range of 40 μm.

The film thickness of the single-layer type photosensitive layer is set to a range of preferably 5 μm to 60 μm, and more preferably from 10 μm to 50 μm.

Binder Resin

The binder resin is not particularly limited, and examples thereof include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinyl carbazole, and polysilane. These binder resins may be used alone or in combination of two or more kinds thereof.

Among these binder resins, particularly from the viewpoint of film forming properties of the photosensitive layer, for example, a polycarbonate resin having a viscosity average molecular weight of 30,000 to 80,000 is preferable.

The content of the binder resin is from 35% by weight to 60% by weight, and preferably from 20% by weight to 35% by weight, with respect to the total solid content of the photosensitive layer.

Charge Generating Materials

The charge generating materials are not particularly limited, but examples thereof include a hydroxygallium phthalocyanine pigment, a chlorogaillium phthalocyanine pigment, a titanylphthalocyanine pigment, and a non-metallic phthalocyanine pigment. These charge generating materials may be used alone or as a mixture of two or more kinds thereof. Among these, from the viewpoint of providing the photoreceptor with higher sensitivity, a hydroxygallium phthalocyanine pigment is preferable, and a Type V hydroxygallium phthalocyanine pigment is more preferable.

Particularly, for example, a hydroxygallium phthalocyanine pigment having a maximum peak wavelength in the range of 810 nm to 839 nm in a spectral absorption spectrum in a wavelength band of 600 nm to 900 nm is preferable as the hydroxygallium phthalocyanine pigment, from the viewpoint of obtaining excellent dispersibility. In this manner, by shifting the maximum absorption wavelength of the spectral absorption spectrum to the short wavelength side, as compared to that of a Type V hydroxygallium phthalocyanine pigment in the related art, the crystal arrangement of pigment particles becomes that of appropriately controlled fine hydroxygallium phthalocyanine pigments, and in the case of being used as a material for an electrophotographic photoreceptor, excellent dispersibility, sufficient sensitivity and chargeability, and dark decay characteristics are easily obtained.

Furthermore, it is preferable that the hydroxygallium phthalocyanine pigment having a maximum peak wavelength in the range of 810 nm to 839 nm has an average particle diameter in a specific range, and a BET specific surface area in a specific range. Specifically, the average particle diameter is preferably 0.20 μm or less, and more preferably from 0.01 μm to 0.15 μm, while the BET specific surface area is preferably 45 $m^2/g$ or more, more preferably 50 $m^2/g$ or more, and particularly preferably from 55 $m^2/g$ to 120 $m^2/g$. The average particle diameter is a value measured using a laser diffraction-scattering type particle size distribution measurement device (LA-700, manufactured by Horiba, Ltd.) as a volume average particle diameter (d50 particle diameter). Further, it is a value measured by a nitrogen purging method using a BET-type specific surface area measurement device (FLOWSOAP II 2300, manufactured by Shimadzu Corporation).

Here, in the case where the average particle diameter is more than 0.20 μm or the specific surface area is less than 45 $m^2/g$, there is a tendency that the pigment particles become coarse or an aggregate of the pigment particles is formed. Further, in some cases, defects in the characteristics such as dispersibility, sensitivity, chargeability, and dark decay characteristics are easily generated, and as a result, the image quality defects are easily formed.

The maximum particle diameter (the maximum value of primary particle diameters) of the hydroxygallium phthalocyanine pigment is preferably 1.2 μm or less, more preferably 1.0 μm or less, and still more preferably 0.3 μm or less. If such maximum particle diameter is over the range, there is a tendency that black spots are easily formed.

From the viewpoint that the photoreceptor prevents a concentration deviation due to exposure to fluorescence or the like, it is preferable that the hydroxygallium phthalocyanine pigment has an average particle diameter of 0.2 μm or less, a maximum particle diameter of 1.2 μm or less, and a specific surface area of 45 $m^2/g$ or more.

The hydroxygallium phthalocyanine pigment is of a Type V having diffraction peaks at Bragg angles (2θ±0.2°) of 7.5°, 9.9°, 12.5°, 16.3°, 18.6°, 25.1°, and 28.3° in an X-ray diffraction spectrum using CuKα characteristic X-rays.

Moreover, the chlorogallium phthalocyanine pigment is not particularly limited, but is preferably one having diffraction peaks at Bragg angles (2θ±0.2°) of 7.4°, 16.6°, 25.5°, and 28.3°, which is capable of providing excellent sensitivity as an electrophotographic photoreceptor material.

The suitable maximum peak wavelength of the spectral absorption spectrum, the average particle diameter, the maximum particle diameter, and the specific surface area of the chlorogallium phthalocyanine pigment are the same as those of the hydroxygallium phthalocyanine pigment.

The content of the charge generating materials in the photosensitive layer is 0.5% by weight or more and less than 2.0% by weight with respect to the entire photosensitive layer. By setting the content of the charge generating materials to these ranges, it is possible to obtain a photoreceptor having high chargeability and high sensitivity. Further, the content of the charge generating materials in the photosensitive layer is preferably from 0.7% by weight to 1.7% by weight, and more preferably from 0.9% by weight to 1.5% by weight, with respect to the entire photosensitive layer.

Incidentally, the content of the charge generating materials is, for example, preferably from 0.05% by weight to 30% by weight, more preferably from 1% by weight to 15% by weight, and still more preferably from 2% by weight to 10% by weight, with respect to the binder resin.

Hole Transporting Materials

The hole transporting materials are not particularly limited, but examples thereof include oxadiazole derivatives such as 2,5-bis(p-diethylaminophenyl)-1, 3, 4-oxadiazole; pyrazoline derivatives such as 1,3,5-tri phenyl-pyrazoline, 1-[pyridyl-(2)]-3-(p-diethylaminostyryl)-5-(p-diethylamino styryl)pyrazoline; aromatic tertiary amino compounds such as triphenylamine, N,N'-bis(3,4-dimethylphenyl)biphenyl-4-amine, tri(p-methylphenyl)aminyl-4-amine, and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5, 6-di(4'-methoxyphenyl)-1, 2,4-triazine; hydrazone derivatives such as 4-diethylaminobenzaldehyde-1, 1-diphenylhydrazone; quinazoline derivatives such as 2-phenyl-4-styrylquinazoline; benzofuran derivatives such as 6-hydroxy-2, 3-di(p-methoxyphenyl)benzofuzan; α-stilbene derivatives such as p-(2,2-diphenylvinyl)-N,N-diphenylaniline; enamine derivatives; carbazole derivatives such as N-ethylcarbazole; poly-N-vinylcarbazole and a derivative thereof; and polymers having a group formed of the above compounds in the main chain or side chain thereof. These hole transporting materials may be used alone or in combination of two or more kinds thereof.

Among these, a triaryl amine derivative represented by the following formula (a-1) and a benzidine derivative represented by the following formula (a-2) are preferable from the viewpoint of charge mobility.

(a-1)

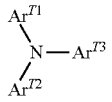

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$ and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of each of the above groups include a halogen atom, an alkyl group having 1 to 5 carbon atoms, and an alkoxy group having 1 to 5 carbon atoms. Other examples of the substituents of each of the above groups include substituted amino groups substituted with an alkyl group having 1 to 3 carbon atoms.

(a-2)

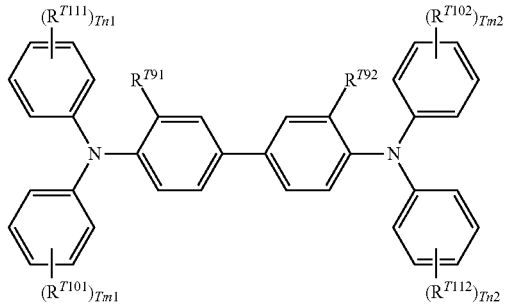

In the formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or —CH=CH—

CH═C($R^{T15}$)($R^{T16}$); $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group; and Tm1, Tm2, Tn1 and Tn2 each independently represent an integer of 0 to 2.

Examples of the substituents of each of the above groups include a halogen atom, an alkyl group having 1 to 5 carbon atoms, and an alkoxy group having 1 to 5 carbon atoms. Other examples of the substituents of each of the above groups include amino groups substituted with an alkyl group having 1 to 3 carbon atoms.

Here, among the triarylamine derivatives represented by the formula (a-1) and the benzidine derivatives represented by the formula (a-2), triarylamine derivatives having "—$C_6H_4$—CH═CH—CH═C($R^{T7}$)($R^{T8}$)" and benzidine derivatives having "—CH═CH—CH═C($R^{T15}$)($R^{T16}$)" are particularly preferable from the viewpoint of charge mobility.

Specific examples of the compound represented by the formula (a-1) and the compound represented by the formula (a-2) include the following compounds.

HT-1

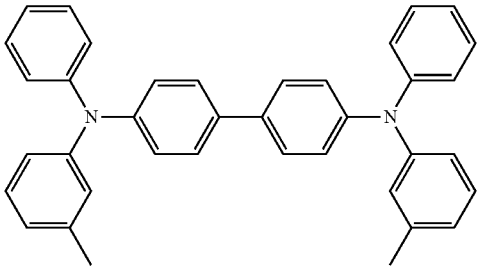

HT-2

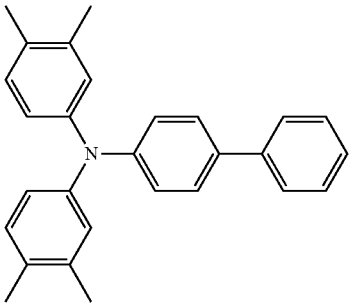

HT-3

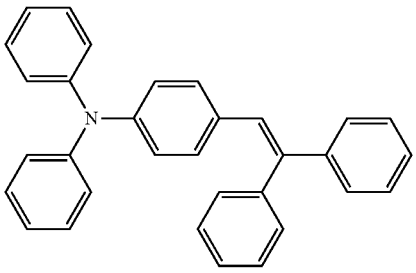

-continued

HT-4

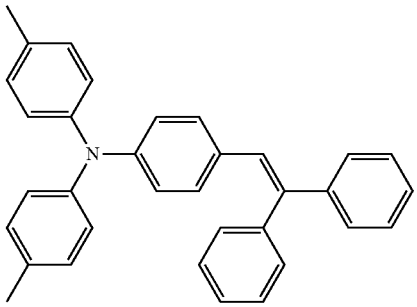

HT-5

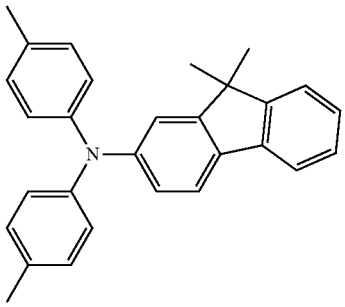

HT-6

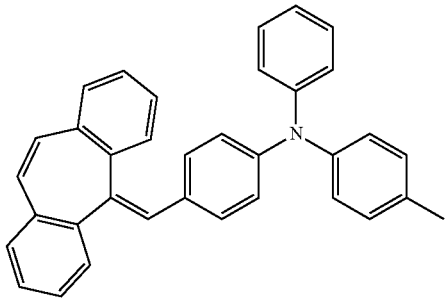

HT-7

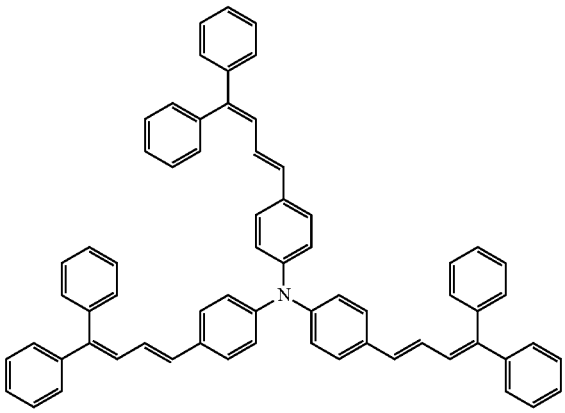

-continued

HT-8

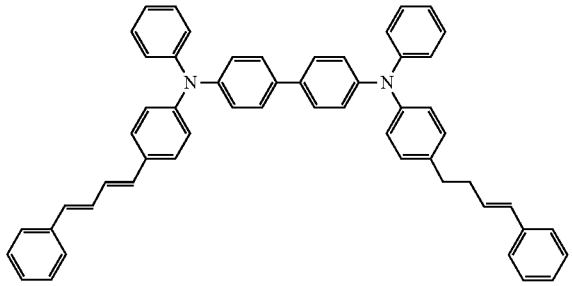

The content of the hole transporting materials is, for example, preferably from 10% by weight to 98% by weight, more preferably from 60% by weight to 95% by weight, and still more preferably from 70% by weight to 90% by weight, with respect to the binder resin.

Electron Transporting Materials

The electron transporting materials are not particularly limited, but examples thereof include quinone compounds such as chloranil and bromanil; tetracyanoquinodimethane compounds; fluorenone compounds such as 2,4,7-trinitrofluorenone, octyl 9-dicyanomethylene-9-fluorenone-4-carboxylate, and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1, 3,4-oxadiazole, and 2,5-bis(4-diethylaminophenyl)-1, 3, 4-oxadiazole; xanthone compounds; thiophene compounds; dinaphthoquinone compounds such as 3, 3'-di-tert-pentyl-dinaphthoquinone; diphenoquinone compounds such as 3,3'-di-tert-butyl-5, 5'-dimethyldiphenoquinone and 3,3',5,5'-tetra-tert-butyl-4,4'-diphenoquinone; and polymers having a group formed of the above compounds in the main chain or side chain thereof. These charge transporting materials may be used alone or in combination of two or more kinds thereof.

Among these, a fluorenone compound represented by the following formula (b-1), a diphenoquinone compound represented by the following formula (b-2), and a dinaphthoquinone compound represented by the following formula (b-3) are preferably used.

(b-1)

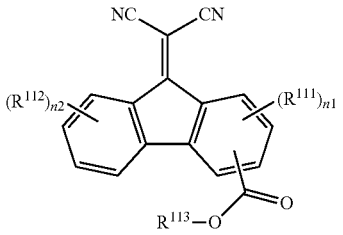

In the formula (b-1), $R^{111}$ and $R^{112}$ each independently represent a halogen atom, an alkyl group, an alkoxy group, an aryl group, or an aralkyl group; $R^{113}$ represents an alkyl group, $-L^{114}-O-R^{115}$, an aryl group, or an aralkyl group; n1, and n2 each independently represent an integer of 0 to 3; $L^{114}$ represents an alkylene group; and $R^{115}$ represents an alkyl group.

In the formula (b-1), examples of the halogen atoms represented by $R^{111}$ and $R^{112}$ include a fluorine atom, a chlorine atom, a bromine atom, and an iodine atom.

In the formula (b-1), examples of the alkyl groups represented by $R^{111}$ and $R^{112}$ include a linear or branched alkyl group having 1 to 4 carbon atoms (preferably 1 to 3 carbon atoms). Specific examples thereof include a methyl group, an ethyl group, a n-propyl group, an isopropyl group, a n-butyl group, an isobutyl group, and a tert-butyl group.

In the formula (b-1), examples of the alkoxy groups represented by $R^{111}$ and $R^{112}$ include an alkoxy group having 1 to 4 carbon atoms (preferably 1 to 3 carbon atoms). Specific examples thereof include a methoxy group, an ethoxy group, a propoxy group, and a butoxy group.

In the formula (b-1), examples of the aryl groups represented by $R^{111}$ and $R^{112}$ include a phenyl group and a tolyl group.

In the formula (b-1), examples of the aralkyl groups represented by $R^{111}$ and $R^{112}$ include a benzyl group, a phenethyl group, and a phenylpropyl group.

Among these, a phenyl group is preferable.

In the formula (b-1), examples of the alkyl group represented by $R^{113}$ include a linear alkyl group having 1 to 0.10 carbon atoms (preferably 5 to 10 carbon atoms) and a branched alkyl group having 3 to 10 carbon atoms (preferably 5 to 10 carbon atoms).

Examples of the linear alkyl group having 1 to 10 carbon atoms include a methyl group, an ethyl group, a n-propyl group, a n-butyl group, a n-pentyl group, a n-hexyl group, a n-heptyl group, a n-octyl group, a n-nonyl group, and a n-decyl group.

Examples of the branched alkyl group having 3 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the formula (b-1), for a group represented by $-L^{114}-O-R^{115}$ represented by $R^{113}$, $L^{114}$ represents an alkylene group and $R^{115}$ represents an alkyl group.

Examples of the alkylene group represented by $L^{114}$ include a linear or branched alkylene group having 1 to 12 carbon atoms, such as a methylene group, an ethylene group, a n-propylene group, an isopropylene group, a n-butylene group, an isobutylene group, a sec-butylene group, a tert-butylene group, a n-pentylene group, an isopentylene group, a neopentylene group, and a tert-pentylene group.

Examples of alkyl group represented by $R^{115}$ include the same groups as the alkyl groups represented by $R^{111}$ and $R^{112}$.

In the formula (b-1), examples of the aryl group represented by $R^{113}$ include a phenyl group, a methylphenyl group, and a dimethylphenyl group.

Further, in the formula (b-1), in the case where $R^{113}$ is an aryl group, it is preferable that the aryl group is further substituted with an alkyl group from the viewpoint of solubility. Examples of the alkyl group substituted with an aryl group include the same group as the alkyl groups represented by $R^{111}$ and $R^{112}$. In addition, specific examples of the aryl group further substituted with an alkyl group include an ethylphenyl group, in addition to the methylphenyl group and the dimethylphenyl group.

In the formula (b-1), examples of the aralkyl group represented by $R^{113}$ include groups represented by $-R^{116}-Ar$, provided that $R^{116}$ represents an alkylene group and Ar represents an aryl group.

Examples of the alkylene group represented by $R^{116}$ include a linear or branched alkylene group having 1 to 12 carbon atoms, such as a methylene group, an ethylene group, a n-propylene group, an isopropylene group, a n-butylene group, an isobutylene group, a sec-butylene group, a tert-butylene group, a n-pentylene group, an isopentylene group, a neopentylene group, and a tert-pentylene group.

Examples of the aryl group represented by Ar include a phenyl group, a methylphenyl group, a dimethylphenyl group, and an ethylphenyl group.

In the formula (b-1), specific examples of the aralkyl group represented by $R^{113}$ include a benzyl group, a methylbenzyl group, a dimethylbenzyl group, a phenylethyl group, a methylphenylethyl group, a phenylpropyl group, and a phenylbutyl group.

As the electron transporting material represented by the formula (b-1), in particular, an electron transporting material, in which $R^{113}$ represents an aralkyl group or a branched alkyl group having 5 to 10 carbon atoms is preferable, and an electron transporting material in which $R^{111}$ and $R^{112}$ each independently represent a halogen atom or an alkyl group, and $R^{113}$ represents an aralkyl group or a branched alkyl group having 5 to 10 carbon atoms is preferable, from the viewpoint of obtaining high sensitivity or the like. Further, from the same viewpoint as above, it is preferable that —CO(═O)—$R^{113}$ is substituted at the 2- or 4-position, and it is particularly preferable that —CO(—O)—$R^{113}$ is substituted at the 4-position.

Exemplary compounds of the electron transporting material represented by the formula (b-L) are shown below, but the invention is not limited thereto. In addition, the following exemplary compound Nos. are denoted as Exemplary compound (b-1-No.) below. Specifically, for example, the exemplary compound 15 is denoted as "Exemplary compound (b-1-15)".

| Exemplary compound | n1 | n2 | $R^{111}$ | $R^{112}$ | —CO(═O)—$R^{113}$ | $R^{113}$ |
|---|---|---|---|---|---|---|
| b-1-1 | 0 | 0 | — | — | 4-CO(═O)—$R^{113}$ | —n-$C_7H_{15}$ |
| b-1-2 | 0 | 0 | — | — | 4-CO(═O)—$R^{113}$ | —n-$C_8H_{17}$ |
| b-1-3 | 0 | 0 | — | — | 4-CO(═O)—$R^{113}$ | —n-$C_5H_{11}$ |
| b-1-4 | 0 | 0 | — | — | 4-CO(═O)—$R^{113}$ | —n-$C_{10}H_{21}$ |
| b-1-5 | 3 | 4 | 1~3-Cl | 1~3-Cl | 4-CO(═O)—$R^{113}$ | —n-$C_7H_{15}$ |
| b-1-6 | 2 | 2 | 1-Cl<br>2-Cl | 5-Cl<br>7-Cl | 4-CO(═O)—$R^{113}$ | —n-$C_7H_{15}$ |
| b-1-7 | 3 | 4 | 1~3-$CH_3$ | 5~8-$CH_3$ | 4-CO(═O)—$R^{113}$ | —n-$C_7H_{15}$ |
| b-1-8 | 3 | 4 | 1~3-$C_4H_9$ | 5~8-$C_4H_9$ | 4-CO(═O)—$R^{113}$ | —n-$C_7H_{15}$ |
| b-1-9 | 2 | 2 | 1-$CH_3O$<br>3-$CH_3O$ | 6-$CH_3O$<br>8-$CH_3O$ | 4-CO(═O)—$R^{113}$ | —n-$C_8H_{17}$ |
| b-1-10 | 3 | 4 | 1~3-$C_6H_5$ | 5~8-$C_6H_5$ | 4-CO(═O)—$R^{113}$ | —n-$C_8H_{17}$ |
| b-1-11 | 0 | 0 | — | — | 4-CO(═O)—$R^{113}$ | —n-$C_4H_9$ |
| b-1-12 | 0 | 0 | — | — | 4-CO(═O)—$R^{113}$ | —n-$C_{11}H_{23}$ |
| b-1-13 | 0 | 0 | — | — | 4-CO(═O)—$R^{113}$ | —n-$C_9H_{19}$ |
| b-1-14 | 0 | 0 | — | — | 4-CO(═O)—$R^{113}$ | —$CH_2$—CH($C_2H_5$)—$C_4H_9$ |
| b-1-15 | 0 | 0 | — | — | 4-CO(═O)—$R^{113}$ | —$(CH_2)_2$—Ph |
| b-1-16 | 0 | 0 | — | — | 4-CO(═O)—$R^{113}$ | —$CH_2$—Ph |
| b-1-17 | 0 | 0 | — | — | 4-CO(═O)—$R^{113}$ | —n-$C_{12}H_{15}$ |
| b-1-18 | 0 | 0 | — | — | 4-CO(═O)—$R^{113}$ | —$C_2H_4$—O—$CH_3$ |
| b-1-19 | 0 | 0 | — | — | 2-CO(═O)—$R^{113}$ | —$CH_2$—Ph |

Furthermore, the abbreviated symbols in the exemplary compounds represent the following meanings.

"No-" represents a substituent substituted at a position with the No. of a fluorene ring. For example, "1-Cl" represents Cl (chlorine atom) substituted at the 1-position of a fluorene ring, and 4-CO(═O)—$R^{113}$ represents —CO(═O)—$R^{113}$ substituted at a 4-position of a fluorene ring.

In addition, "1- to 3-" means that substituents are substituted at all of the 1- to 3-positions, and "5- to 8-" means that substituents are substituted at all of the 5- to 8-positions.

"Ph" represents a phenyl group.

(b-2)

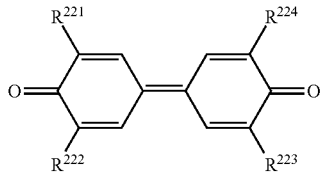

In the formula (b-2), $R^{221}$, $R^{222}$, $R^{223}$, and $R^{224}$ each independently represent a hydrogen atom, a halogen atom, an alkyl group, an alkoxy group, an aryl group, or an aralkyl group.

In the formula (b-2), examples of the halogen atom represented by $R^{221}$, $R^{222}$, $R^{223}$, and $R^{224}$ include a fluorine atom, a chlorine atom, a bromine atom, and an iodine atom.

In the formula (b-2), examples of the alkyl group represented by $R^{221}$, $R^{222}$, $R^{223}$, and $R^{224}$ include a linear or branched alkyl group having 1 to 6 carbon atoms (preferably 1 to 4 carbon atoms). Specific examples thereof include a methyl group, an ethyl group, a n-propyl group, an isopropyl group, a n-butyl group, an isobutyl group, and a tert-butyl group.

In the formula (b-2), examples of the alkoxy group represented by $R^{221}$, $R^{222}$, $R^{223}$, and $R^{224}$ include a linear or branched alkoxy group having 1 to 4 carbon atoms (preferably 1 to 3 carbon atoms), and specific examples thereof include a methoxy group, an ethoxy group, a propoxy group, and a butoxy group.

In the formula (b-2), examples of the aryl group represented by $R^{221}$, $R^{222}$, $R^{223}$, and $R^{224}$ include a phenyl group and a tolyl group.

In the formula (b-2), examples of the aralkyl group represented by $R^{221}$, $R^{222}$, $R^{223}$, and $R^{224}$ include a benzyl group, a methylbenzyl group, a dimethylbenzyl group, a phenylethyl group, a methylphenylethyl group, a phenylpropyl group, and a phenylbutyl group.

Exemplary compounds of the electron transporting material represented by the formula (b-2) are shown below, but the invention is not limited thereto. In addition, the following exemplary compound Nos. are denoted as Exemplary compound (b-2-No.) below. Specifically, for example, Exemplary Compound 1 is denoted as "Exemplary compound (b-2-1)".

| Exemplary compound | $R^{221}$ | $R^{222}$ | $R^{223}$ | $R^{224}$ |
|---|---|---|---|---|
| b-2-1 | t-Bu | t-Bu | t-Bu | t-Bu |
| b-2-2 | H | t-Bu | t-Bu | t-Bu |
| b-2-3 | H | H | t-Bu | t-Bu |
| b-2-4 | H | H | H | t-Bu |
| b-2-5 | t-Bu | H | H | t-Bu |
| b-2-6 | Me | Me | Me | Me |
| b-2-7 | Me | Me | t-Bu | t-Bu |
| b-2-8 | F | F | t-Bu | t-Bu |
| b-2-9 | MeO | MeO | i-Pr | i-Pr |
| b-2-10 | MeO | MeO | t-Bu | t-Bu |
| b-2-11 | Ph | Ph | Ph | Ph |

Furthermore, the abbreviated symbols in the exemplary compounds represent the following meanings.

"t-Bu" represents a tert-butyl group, "i-Pr" represents an isopropyl group, "Me" represents a methyl group, "MeO" represents a methoxy group, and "Ph" represents a phenyl group.

(b-3)

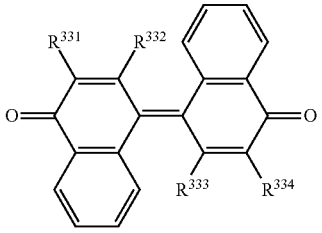

In the formula (b-3), $R^{331}$, $R^{332}$, $R^{333}$, and $R^{334}$ each independently represent a hydrogen atom, a halogen atom, an alkyl group, an alkoxy group, an aryl group, or an aralkyl group.

In the formula (b-3), examples of the halogen atom represented by $R^{331}$, $R^{332}$, $R^{333}$, and $R^{334}$ include a fluorine atom, a chlorine atom, a bromine atom, and an iodine atom.

In the formula (b-3), examples of the alkyl group represented by $R^{331}$, $R^{332}$, $R^{333}$, and $R^{334}$ include a linear or branched alkyl group having 1 to 6 carbon atoms (preferably 1 to 5 carbon atoms). Specific examples thereof include a methyl group, an ethyl group, a n-propyl group, an isopropyl group, a n-butyl group, an isobutyl group, a tert-butyl group, and a tert-pentyl group.

In the formula (b-3), examples of the alkoxy group represented by $R^{331}$, $R^{332}$, $R^{333}$, and $R^{334}$ include a linear or branched alkoxy group having 1 to 4 carbon atoms (preferably 1 to 3 carbon atoms), and specific examples thereof include a methoxy group, an ethoxy group, a propoxy group, and a butoxy group.

In the formula (b-3), examples of the aryl group represented by $R^{331}$, $R^{332}$, $R^{333}$, and $R^{334}$ include a phenyl group and a tolyl group.

In the formula (b-3), examples of the aralkyl group represented by $R^{331}$, $R^{332}$, $R^{333}$, and $R^{334}$ include a benzyl group, a methylbenzyl group, a dimethylbenzyl group, a phenylethyl group, a methylphenylethyl group, a phenylpropyl group, and a phenylbutyl group.

Exemplary compounds of the electron transporting material represented by the formula (b-3) are shown below, but the invention is not limited thereto. In addition, the following exemplary compound Nos. are denoted as Exemplary compound (b-3-No.) below. Specifically, for example, Exemplary Compound 1 is denoted as "Exemplary compound (b-3-1)".

| Exemplary compound | $R^{331}$ | $R^{332}$ | $R^{333}$ | $R^{334}$ |
|---|---|---|---|---|
| b-3-1 | t-Pen | H | H | t-Pen |
| b-3-2 | t-Bu | H | H | t-Bu |
| b-3-3 | i-Pr | H | H | i-Pr |
| b-3-4 | MeO | H | H | MeO |
| b-3-5 | Ph | H | H | Ph |
| b-3-6 | —$CH_2$—Ph | H | H | —$CH_2$—Ph |
| b-3-7 | t-Bu | H | H | H |
| b-3-8 | Me | Me | Me | Me |
| b-3-9 | Me | H | H | Me |

Furthermore, the abbreviated symbols in the exemplary compounds represent the following meanings.

"t-Pen" represents a tert-pentyl group, "t-Bu" represents a tert-butyl group, "i-Pr" represents an isopropyl group, "Me" represents a methyl group, "MeO" represents a methoxy group, and "Ph" represents a phenyl group.

The content of the electron transporting materials is, for example, preferably from 4% by weight to 70% by weight, more preferably from 8% by weight to 50% by weight, and still more preferably from 10% by weight to 30% by weight, with respect to the binder resin.

Furthermore, it is preferable that the electron transporting materials are contained in a region having the charge generating materials present therein, from the viewpoint of obtaining high sensitivity. Further, in the case of forming a region having no charge generating materials present therein, electron transporting materials may be contained in this region, but the electron transporting materials may not be contained. That is, a binder resin, charge generating materials, hole transporting materials, and electron transporting materials are contained in a region containing the charge generating materials, and a photosensitive layer including a binder resin and hole transporting materials (that is, not containing charge generating materials and electron transporting materials) may be formed in a region not containing charge generating materials.

Weight Ratio of Hole Transporting Materials to Electron Transporting Materials

The ratio of the hole transporting materials to the electron transporting materials in terms of a weight ratio (hole transporting materials/electron transporting materials) is preferably from 50/50 to 90/10, and more preferably from 60/40 to 80/20.

Other Additives

The single-layer type photosensitive layer may include known additives such as an antioxidant, a light stabilizer, and a heat stabilizer. Further, in the case where the single-layer type photosensitive layer is a surface layer, it may include fluorine resin particles, a silicone oil, or the like.

Formation of Single-Layer Type Photosensitive Layer

A method for forming the single-layer type photosensitive layer of the present exemplary embodiment will be described.

The method for forming the single-layer type photosensitive layer is not particularly limited, and for example, in the case where an undercoat layer is formed on a conductive substrate, a single-layer type photosensitive layer is formed on the undercoat layer provided on the conductive substrate. An example thereof is a method including preparing a coating liquid for forming a photosensitive layer containing charge generating materials, coating the coating liquid for forming a photosensitive layer on the conductive substrate to form a coating film, and heating and drying the coating film to form a single-layer type photosensitive layer.

Incidentally, the preparation of the coating liquid for forming a photosensitive layer includes preparing a first coating liquid for forming a photosensitive layer, containing charge generating materials, and preparing a second coating liquid for forming a photosensitive layer, containing charge generating materials in a smaller amount (including a case of not containing charge generating materials) than that in the first coating liquid for forming a photosensitive layer.

In addition, the formation of the coating film includes coating the second coating liquid for forming a photosensitive layer and the first photosensitive layer coating liquid on the conductive substrate to form a second coating film and a first coating film. More specifically, the formation of the coating film includes coating the second coating liquid for forming a photosensitive layer on the conductive substrate to form a coating second coating film, and coating the first coating liquid for forming a photosensitive layer on the second coating film to form a first coating film.

Hereinbelow, a specific method for forming a single-layer type photosensitive layer will be described.

Preparation of Coating liquid for Forming Photosensitive Layer

First, a coating liquid for forming a photosensitive layer is prepared. For example, a first coating liquid for forming a photosensitive layer obtained by adding the respective components such as charge generating materials to a solvent, and a second coating liquid for forming a photosensitive layer which contains a smaller amount of charge generating materials than that of the first coating liquid for forming a photosensitive layer are prepared. However, in the case of forming a region having charge generating materials not present in the conductive substrate side of the photosensitive layer, a coating liquid not containing charge generating materials is prepared in the second coating liquid for forming a photosensitive layer. Further, for the film thickness direction of the photosensitive layer, in the case of the content of the charge generating materials is stepwise decreased to give an inclination, a third coating liquid for forming a photosensitive layer, in which the content of charge generating materials is smaller than that of the first coating liquid for forming a photosensitive layer, and is larger than that of the second coating liquid for forming a photosensitive layer, may be prepared.

Furthermore, for example, in the case where the second coating liquid for forming a photosensitive layer does not contain charge generating materials, a second coating liquid for forming a photosensitive layer, including a binder resin, electron transporting materials, and hole transporting materials, may be prepared, or a second coating liquid for forming a photosensitive layer, including a binder resin and hole transporting materials (that is, a coating liquid not containing charge generating materials and electron transporting materials) may be prepared.

Each of the coating liquids for forming a photosensitive layer is prepared by adding the components to a solvent.

Examples of the solvent used in each of the coating liquids for forming a photosensitive layer include organic solvents including aromatic hydrocarbons such as benzene, toluene, xylene, and chlorobenzene; ketones such as acetone, 2-butanone, and methylethylketone; halogenated aliphatic hydrocarbons such as methylene chloride, chloroform, and ethylene chloride; cyclic or linear ethers such as tetrahydrofuran and ethyl ether; and aliphatic hydrocarbons such as 2-methylpentane and cyclopentane. These solvents may be used alone or as a mixture of two or more kinds thereof.

Furthermore, for a method for dispersing particles (for example, charge generating materials) in the coating liquid for forming a photosensitive layer, for example, a media dispersing machine such as a ball mill, a vibrating ball mill, an attritor, a sand mill, and a horizontal sand mill; or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion liquid to collide against liquid or against walls under a high pressure, and a penetration system in which the particles are dispersed by causing the dispersion liquid to penetrate through a fine flow path under a high-pressure state.

Formation of Coating Film

Next, the coating liquid for forming a photosensitive layer is coated on the conductive substrate to form a coating film. For example, the second coating liquid for forming a photosensitive layer is coated on the conductive substrate to form a second coating film, and the first coating liquid for forming a photosensitive layer is coated on the second coating film to form a first coating film.

Furthermore, in the case of using the third coating liquid for forming a photosensitive layer to form a third coating film, the process further includes coating the second coating film with the third photosensitive layer coating liquid to form a third coating film before forming the first coating film. In this case, a coating film having a stepwise decreasing content of the charge generating materials from the first coating film toward to the second coating film with respect to the film thickness direction of the photosensitive layer may be formed.

The method for coating the second coating liquid for forming a photosensitive layer and the method for coating the first coating liquid for forming a photosensitive layer are not particularly limited. Examples thereof include methods such as an ink jet coating method, a dipping coating method, a blade coating method, a wire bar coating method, a spray coating method, a ring coating method, a bead coating method, an air knife coating method, and a curtain coating method. Taking into consideration the efficiency for forming a photosensitive layer, it is preferable to use the same method as the method for forming the second coating liquid for forming a photosensitive layer and the method for coating the first coating liquid for forming a photosensitive layer.

However, for example, as for a film forming method by a dipping coating method, when the first coating liquid for forming a photosensitive layer is coated on the second coating film, both of the first coating liquid for forming a photosensitive layer and the second coating film component are not mixed together in some cases. As a result, a photosensitive layer configured such that the charge generating materials are unevenly distributed in the surface side of the photosensitive layer is hardly formed in some cases.

Accordingly, in order to form a photosensitive layer in which the charge generating materials are unevenly distributed in the surface side of the photosensitive layer, it is preferable to employ a coating method in which all of the first coating liquid for forming a photosensitive layer and the second coating film component are not mixed together. Examples of such a coating method include methods such as an ink jet coating method and a spray coating method. Among these coating methods, it is preferable to employ an ink jet coating method from the viewpoint of efficiently forming a photosensitive layer.

In addition, according to this method, a single-layer type photosensitive layer in which a clear interface is not present in the boundary of the region on the conductive substrate side having a small amount of the charge generating materials present may be formed.

Next, an ink jet coating method which is an example of preferable coating methods as a method for forming a single-layer type photosensitive layer will be described.

Figure 2A:
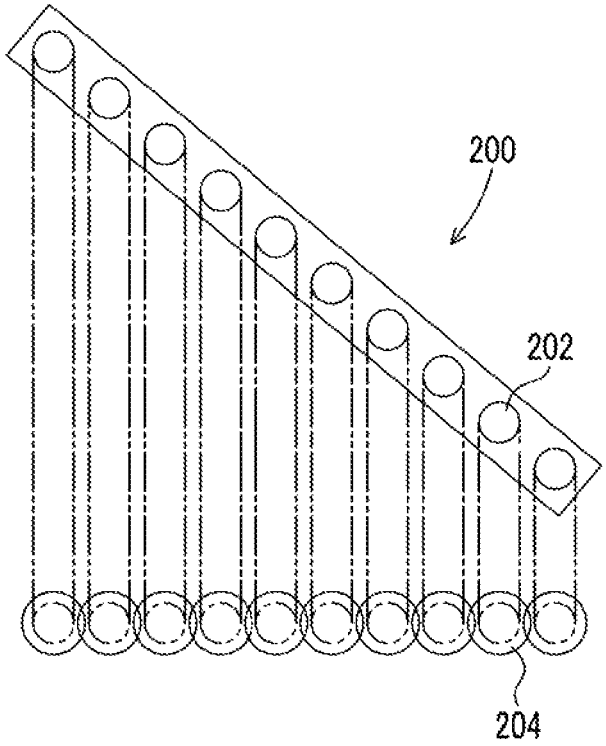
FIG. 2A is a schematic view showing the overlapping state of a part of liquid droplets landed by jetting from a liquid droplet discharge portion by an ink jet coating method.
Figure 2B:
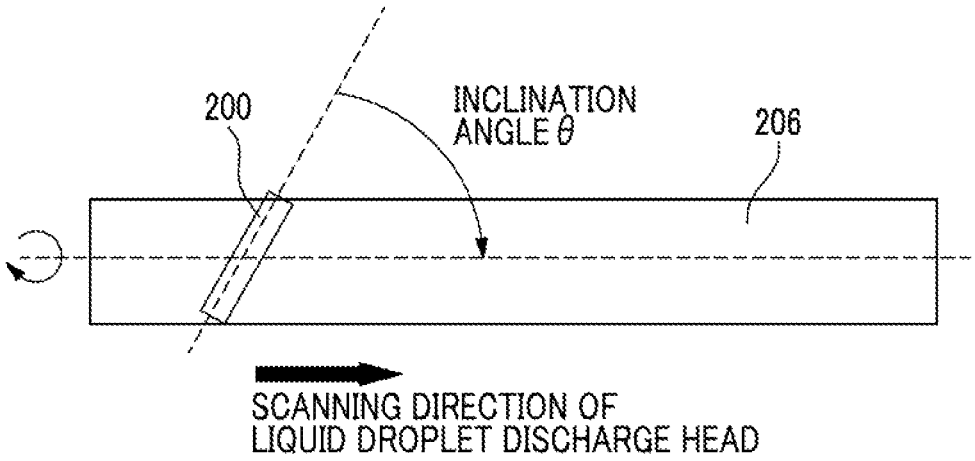
FIG. 2B is a schematic view showing the inclination of the liquid droplet discharge portion with respect to a conductive substrate.
Figure 3:
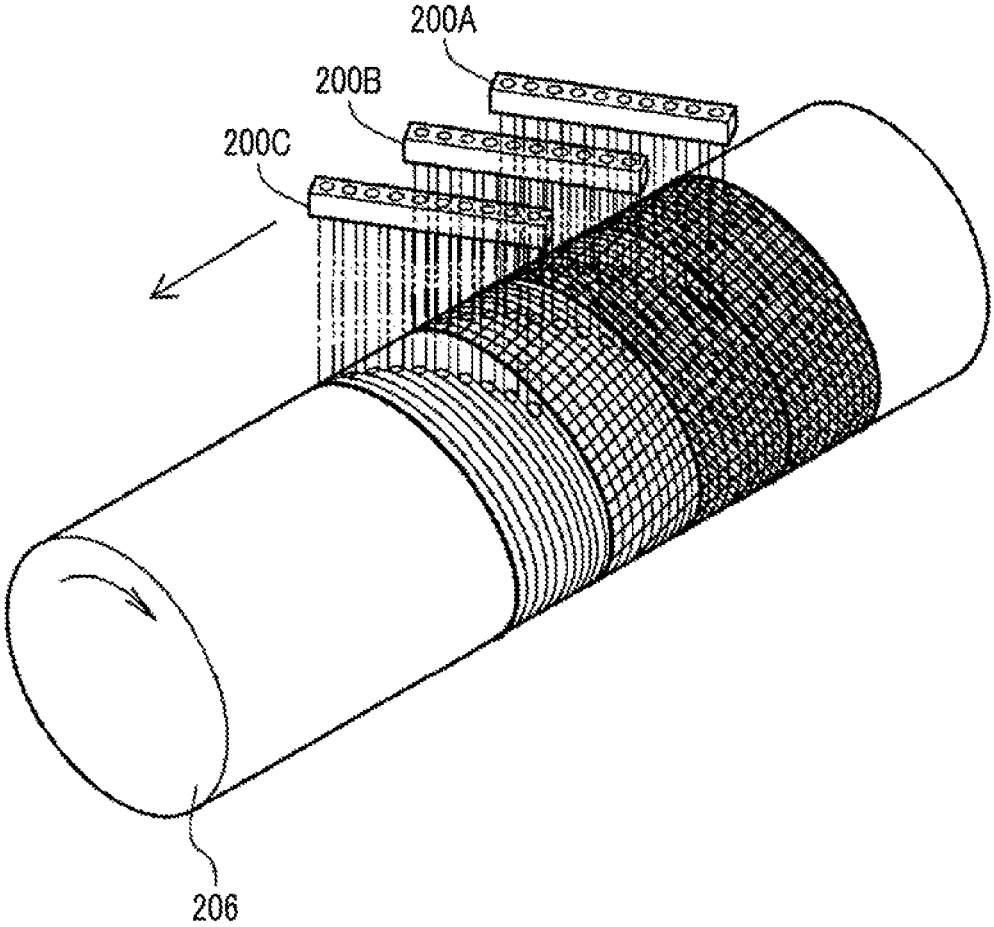
FIG. 3 is a schematic view showing an example of a method for forming a photosensitive layer by an ink jet coating method.

FIGS. 2A to 3 schematically show an example of a method for forming a coating film according to an ink jet coating method. As shown in FIG. 2B, a liquid droplet discharge portion 200 is provided as being inclined with respect to the axis of the conductive substrate 206. Further, the coating liquid for forming a photosensitive layer, jetted from the respective nozzles 202 of the liquid droplet discharge portion 200, is landed on the surface of the conductive substrate 206, and then coated in the state where adjacent liquid droplets 204 are adjacent to each other. That is, as shown in FIG. 2A, the size of the liquid droplets immediately after jetting is substantially the same as the nozzle diameter as seen by dotted lines, but the coating liquid for forming a photosensitive layer spreads after being landed on the surface of the conductive substrate 206 as seen by solid lines, and is contacted with the adjacent liquid droplets, thereby forming a coating film.

Specifically, as shown in FIG. 3, the liquid droplet discharge portion is installed in a device rotating the axis of the conductive substrate 206 horizontally. Next, in order to jet the liquid droplets of the coating liquid for forming a photosensitive layer onto to the conductive substrate 206, the first liquid droplet discharge portion 200A, the second liquid droplet discharge portion 200B, and the third liquid droplet discharge portion 200C are disposed, and the coating liquid for forming a photosensitive layer is charged in the respective liquid droplet discharge portions 200A to 200C. In this state, the conductive substrate 206 is rotated, and the coating liquid for forming a photosensitive layer is jetted from the nozzles 202 provided in the respective liquid droplet discharge portions 200A to 200C. Further, the first liquid droplet discharge portion 200A, the second liquid droplet discharge portion 200B, and the third liquid droplet discharge portion 200C are moved horizontally from one end of the conductive substrate 206 to the other side end, in the direction of the arrow in FIG. 3, thereby forming a coating film.

For example, the first coating liquid for forming a photosensitive layer, including the charge generating materials and the like, is charged in the first liquid droplet discharge portion 200A, and the second coating liquid for forming a photosensitive layer, including a smaller amount (none) of the charge generating materials than that of the first coating liquid for forming a photosensitive layer, is charged in the second liquid droplet discharge portion 200B (in this case, the third liquid droplet discharge portion 200C is not used).

Alternatively, the first coating liquid for forming a photosensitive layer, including the charge generating materials and the like, is charged in the first liquid droplet discharge portion 200A, and the second coating liquid for forming a photosensitive layer, including a smaller amount (none) of the charge generating materials than that of the first coating liquid for forming a photosensitive layer, is charged in the second liquid droplet discharge portion 200B and the third liquid droplet discharge portion 200C.

In addition, a single-layer type photosensitive layer having a region on the conductive substrate side having a small content of the charge generating layer and a region on the surface side having a large content of the charge generating layer are formed by forming a coating film as described above.

Furthermore, for example, in the case of using the third coating liquid for forming a photosensitive layer as described above, a coating film may also be formed by charging the second coating liquid for forming a photosensitive layer in the third liquid droplet discharge portion 200C; charging the third coating liquid for forming a photosensitive layer as described above in the second liquid droplet discharge portion 200B; and charging the first coating liquid for forming a photosensitive layer, including the charge generating materials and the like, in the first liquid droplet discharge portion 200A.

Moreover, in the case of forming a protective layer, the second coating liquid for forming a photosensitive layer is charged in the third liquid droplet discharge portion 200C, the first coating liquid for forming a photosensitive layer is charged in the second liquid droplet discharge portion 200B, and the coating liquid for forming a protective layer is charged in the first liquid droplet discharge portion 200A to provide a photosensitive layer, and further provide a protective layer.

Furthermore, examples in which the coating liquid for forming a photosensitive layer is charged in the respective liquid droplet discharge portions 200A to 200C are mainly mentioned in the above description, but the invention is not limited thereto. Further, in FIG. 3, examples in which three liquid droplet discharge portions of the first liquid droplet discharge portion 200A to the third liquid droplet discharge portion 200C are installed as the liquid droplet discharge portion are mentioned, but the invention is not limited thereto. The number of the liquid droplet discharge portions may be provided, depending on the film thickness of the photosensitive layer, the amount of the liquid droplet jetted, and the like as long as the charge generating materials are unevenly distributed in the photosensitive layer.

The amount of the liquid droplets of the coating liquid for forming a photosensitive layer, which are jetted from the nozzles 202 of the liquid droplet discharge portion 200 by the ink jet coating method, is not particularly limited, but it is, for example, from 1 pl to 50 pl.

As a jetting system of liquid droplets by an ink jet coating method, for example, a continuous system, or an intermittent system (of a piezo type, a thermal type, an electrostatic type, or the like) is used and is not particularly limited. However, a continuous type or intermittent type of a piezo system (a system using a piezo element (piezoelectric element)) is preferable. Particularly, from the viewpoint of obtaining a thin film having a smaller film thickness and reducing the amount of waste fluids, an intermittent type using a piezo element is more preferable.

Formation of Photosensitive Layer

A single-layer type photosensitive layer of the present exemplary embodiment is formed by heating and drying the coating film formed by the formation of the coating film by a method using drying with hot air, or the like. The conditions for drying the coating film is not particularly limited as long as the coating film is dried and cured, and it may be set by, for example, the kind of a solvent, or the like. Specifically, examples of the conditions include a drying temperature in the range of 100° C. to 170° C. and a drying time in the range of 10 minutes to 120 minutes.

Protective Layer

A protective layer is provided on the photosensitive layer, as desired. The protective layer is provided for the purpose of, for example, preventing the chemical change of the photosensitive layer during charging, or further improving the mechanical strength of the photosensitive layer.

Thus, for the protective layer, a layer constituted with a cured film (crosslinked film) is preferably applied. Examples of these layers include the layers shown in 1) or 2) below.

1) A layer constituted with a cured film of a composition including a reactive group-containing charge transporting material having a reactive group and a charge transporting skeleton in the same molecule (that is, a layer including a polymer or a crosslinked form of the reactive group-containing charge transporting material); and 2) a layer constituted with a cured film of a composition including neither a non-reactive charge transporting material nor a charge transporting skeleton, but having a reactive group-containing non-charge transporting material having a reactive group (that is, a layer including a polymer or a crosslinked form of the non-reactive charge transporting material and the reactive group-containing non-charge transporting material).

Examples of the reactive group of the reactive group-containing charge transporting material include known reactive groups such as a chain polymerizable group, an epoxy group, —OH, —OR [provided that R represents an alkyl group], —$NH_2$, —SH, —COOH, and —$SiR^{Q1}_{3-Qn}(OR^{Q2})_{Qn}$ [provided that $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3].

The chain polymerizable group is not particularly limited as long as it is a functional group capable of causing radical polymerization, and it is, for example, a functional group having at least carbon double bonds. Specific examples thereof include a group containing at least one selected from a vinyl group, a vinyl ether group, a vinyl thioether group, a styryl group (vinylphenyl group), an acryloyl group, a methacryloyl group, and derivatives thereof, and the like. Among these, the chain polymerizable group is preferably a group containing at least one selected from a vinyl group, a styryl group (vinylphenyl group), an acryloyl group, a methacryloyl group, and derivatives thereof in terms of its excellent reactivity.

The charge transporting skeleton of the reactive group-containing charge transporting material is not particularly limited as long as it has a known structure in the electrophotographic photoreceptor, and examples thereof include skeletons derived from nitrogen-containing hole transporting compounds such as a triarylamine compound, a berzidine compound, and a hydrazone compound, and include structures conjugated with nitrogen atoms. Among these, a triarylamine skeleton is preferable.

These reactive group-containing charge transporting material having a reactive group and a charge transporting skeleton, non-reactive charge transporting materials, and reactive group-containing non-charge transporting materials may be selected from known materials.

A known additive may be additionally included in the protective layer.

The formation of the protective layer is not particularly limited, and known forming methods are used. For example, the formation of the protective layer is carried out by forming a coating film of the coating liquid for forming a protective layer obtained by adding the components to the solvent, drying the coating film, and performing a curing treatment such as heating, as desired.

Examples of the solvent for preparing a coating liquid for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or as a mixture of 2 or more kinds thereof.

Further, the coating liquid for forming a protective layer may be a solvent-free coating liquid.

Further, as a method for coating the coating liquid for forming a protective layer on a photosensitive layer (for example charge transporting layer) include ordinary methods such as a dipping coating method, an extrusion coating method, a wire bar coating method, a spraying method, a blade coating method, a knife coating method, and a curtain coating method.

The film thickness of the protective layer is set to a range of, for example, preferably from 1 μm to 20 μm, and more preferably from 2 μm to 10 μm.

Image Forming Apparatus (and Process Cartridge)

The image forming apparatus according to the present exemplary embodiment is provided with an electrophotographic photoreceptor, a charging unit that charges the surface of the electrophotographic photoreceptor, an electrostatic latent image forming unit that forms an electrostatic latent image on the surface of the charged electrophotographic photoreceptor, a developing unit that develops the electrostatic latent image formed on the surface of the electrophotographic photoreceptor by a developer including a toner to form a toner image, and a transfer unit that transfers the toner image onto a surface of a recording medium. Further, the electrophotographic photoreceptor according to the present exemplary embodiment is applied as the electrophotographic photoreceptor.

As the image forming apparatus according to the present exemplary embodiment, known image forming apparatuses provided with a device including a fixing unit that fixes a toner image transferred to the surface of a recording medium; a direct transfer type device that directly transfers the toner image formed on the surface of the electrophotographic photoreceptor to a recording medium; an intermediate transfer type device that primarily transfers the toner image formed on the surface of the electrophotographic photoreceptor to the surface of an intermediate transfer member, and secondarily transfers the toner image transferred to the surface of the intermediate transfer member to the surface of the recording medium; a device provided with a cleaning unit that cleans the surface of the electrophotographic photoreceptor before charging, after the transfer of the toner image; a device provided with a charge erasing unit that erases charges by irradiating the surface of the electrophotographic photoreceptor with charge erasing light before charging, after the transfer of the toner image; a device provided with an electrophotographic photoreceptor heating unit that increases the temperature of the electrophotographic photoreceptor to reduce the relative temperature; and the like are applied.

In the case of the intermediate transfer type device case, for the transfer unit, for example, a configuration in which an intermediate transfer member to the surface of which the toner image is transferred, a first transfer unit that primarily transfers a toner image formed on the surface of the electrophotographic photoreceptor to the surface of the intermediate transfer member, and a secondary transfer unit that secondarily transfers the toner image transferred to the surface of the intermediate transfer member to the surface of the recording medium is applied.

The image forming apparatus according to the present exemplary embodiment is any one of a dry development type image forming apparatus and a wet development type (development type using a liquid developer) image forming apparatus.

Furthermore, in the image forming apparatus according to the present exemplary embodiment, for example, a part provided with the electrophotographic photoreceptor may be a cartridge structure (process cartridge) that is detachable from an image forming apparatus. As the process cartridge, for example, a process cartridge including the electrophotographic photoreceptor according to the present exemplary embodiment is suitably used. Further, the process cartridge may include, in addition to the electrophotographic photoreceptor, for example, at least one selected from the group consisting of a charging unit, an electrostatic latent image forming unit, a developing unit, and a transfer unit.

Hereinbelow, one example of the image forming apparatuses according to the present exemplary embodiment is shown, but the exemplary embodiment of the invention is not limited thereto. Further, the main parts shown in the figures are described, and explanation of the others will be omitted.

Figure 4:
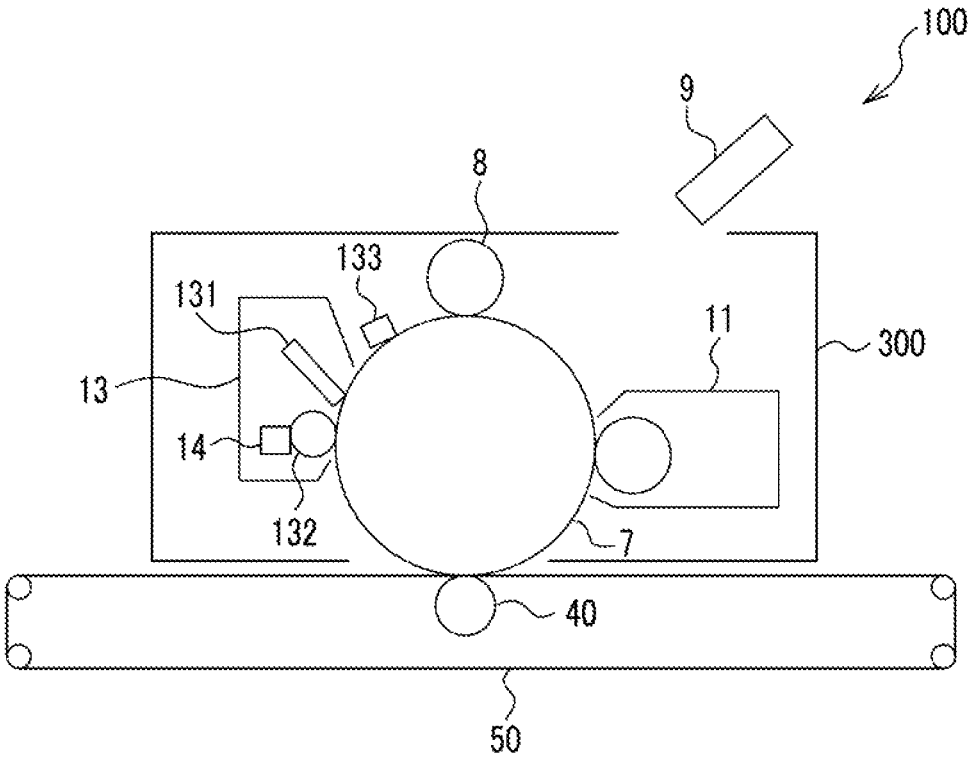
FIG. 4 is a schematic structural view showing an image forming apparatus according to the exemplary embodiment.

FIG. 4 is a schematic structural view showing an example of the image forming apparatus according to the present exemplary embodiment.

The image forming apparatus 100 according to the present exemplary embodiment is provided with a process cartridge 300 provided with an electrophotographic photoreceptor 7 as shown in FIG. 4, an exposure device 9 (one example of the electrostatic latent image forming unit), a transfer device 40 (primary transfer device), and an intermediate transfer member 50. Further, in the image forming apparatus 100, the exposure device 9 is arranged at a position where the exposure device 9 may radiate light onto the electrophotographic photoreceptor 7 through an opening in the process cartridge 300, and the transfer device 40 is arranged at a position opposite to the electrophotographic photoreceptor 7 by the intermediary of the intermediate transfer member 50. The intermediate transfer member 50 is arranged to contact partially the electrophotographic photoreceptor 7. Further, although not shown in the figure, the apparatus also includes a secondary transfer device that transfers a toner image transferred onto the intermediate transfer member 50 to a recording medium (for example, paper). In addition, the intermediate transfer member 50, the transfer device 40 (primary transfer device), and the secondary transfer device (not shown) correspond to an example of the transfer unit.

The process cartridge 300 in FIG. 4 supports, in a housing, the electrophotographic photoreceptor 7, a charging device 8 (one example of the charging unit), a developing device 11 (one example of the cleaning unit), and a cleaning device 13 (one example of the cleaning unit) as a unit. The cleaning device 13 has a cleaning blade (one example of the cleaning member) 131, and the cleaning blade 131 is arranged so as to be in contact with the surface of the electrophotographic photoreceptor 7. Further, the cleaning member is not an embodiment of the cleaning blade 131, may be a conductive or insulating fibrous member, and may be used alone or in combination with the cleaning blade 131.

In addition, FIG. 4 shows an example including a fibrous member 132 (in a roll shape) supplying a lubricant 14 to the surface of the electrophotographic photoreceptor 7 and a fibrous member 133 (in a flat brush shape) assisting the cleaning process, but these are disposed as desired.

Hereinbelow, the respective configurations of the image forming apparatus according to the present exemplary embodiment will be described.

Charging Device

As the charging device 8, for example, a contact type charging device using a conductive or semiconductive charging roll, a charging brush, a charging film, a charging rubber blade, a charging tube, or the like is used. Further, known charging devices themselves, such as a non-contact type roller charging device, and a scorotron charging device and a corotron charging device, each using corona discharge are also used.

Exposure Device

The exposure device 9 may be an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in the range of the spectral sensitivity wavelengths of the electrophotographic photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which a magnetic or non-magnetic single-component or two-component developer is contacted or not contacted for forming an image, may be used. Such a developing device 11 is not particularly limited as long as it has the above-described functions, and may be appropriately selected according to the intended use. Examples thereof include a known developing device in which the single-component or two-component developer is applied to the electrophotographic photoreceptor 7 using a brush or a roller. Among these, the developing device using developing roller retaining developer on the surface thereof is preferable.

The developer used in the developing device 11 may be a single-component developer formed of a toner alone or a two-component developer formed of a toner and a carrier. Further, the toner may be magnetic or non-magnetic. As the developer, known ones may be applied.

Cleaning Device

As the cleaning device 13, a cleaning blade type device provided with the cleaning blade 131 is used.

Furthermore, in addition to the cleaning blade type, a fur brush cleaning type and a type performing developing and cleaning at once may also be employed.

Transfer Device

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

Figure 5:
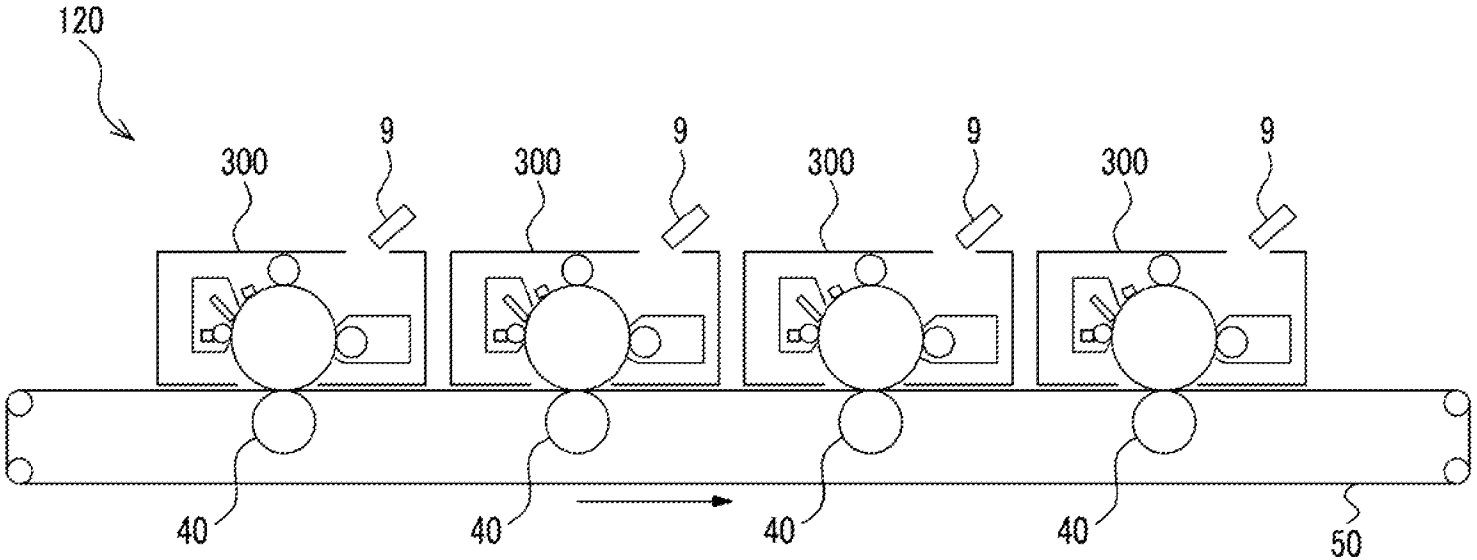
FIG. 5 is a schematic structural view showing an image forming apparatus according to another exemplary embodiment.

FIG. 5 is a schematic structural view showing another example of the image forming apparatus according to the present exemplary embodiment.

The image forming apparatus 120 shown in FIG. 5 is a tandem type full color image forming apparatus equipped with four process cartridges 300. In the image forming apparatus 120, four process cartridges 300 are disposed parallel with each other on the intermediate transfer member 50, and one electrophotographic photoreceptor may be used for one color. Further, the image forming apparatus 120 has the same configuration as the image forming apparatus 100, except that it is a tandem type.

The image forming apparatus 100 according to the exemplary embodiment is not limited to the above-described configuration. For example, in order to make uniform polarity of the residual toner and facilitate cleaning with the cleaning brush or the like, a first erasing device may be provided around the electrophotographic photoreceptor 7 so as to be disposed at the downstream side of the transfer device 40 in the rotational direction of the electrophotographic photoreceptor 7 and the upstream side of the cleaning device 13 in the rotational direction of the electrophotographic photoreceptor 7. Further, in order to erase the electricity of the surface of the electrophotographic photoreceptor 7, a second erasing device may be provided at the downstream side of the cleaning device 13 in the rotational direction of the electrophotographic photoreceptor and the upstream side of the charging device 8 in the rotational direction of the electrophotographic photoreceptor.

Moreover, the image forming apparatus 100 according to the present exemplary embodiment is not limited to the above-mentioned configuration, and known configurations, for example, an image forming apparatus in an image forming apparatus that directly transfers the toner image formed on the electrophotographic photoreceptor 7 to the recording medium may be employed.

EXAMPLES

Hereinbelow, the present exemplary embodiments will be described in detail with reference to Examples, but are not construed to be limited to these Examples. Further, in the following description, "part(s)" and "%" mean "part(s) by weight" and "% by weight" unless otherwise specified.

Preparation of Electrophotographic Photoreceptor

Example 1

50 parts by weight of a bisphenol Z polycarbonate resin (viscosity average molecular weight: 50,000) and 40 parts by weight of the hole transporting materials shown in Table 1 are dissolved in 250 parts by weight of tetrahydrofuran and 250 parts by weight of toluene to thereby obtain a coating liquid A for forming a photosensitive layer.

A mixture formed of 1.5 parts by weight of a Type V hydroxygallium phthalocyanine pigment having diffraction peaks at the positions at at least 7.3°, 16.0°, 24.9°, and 28.0° of Bragg angles (2θ±0.2°) in an X-ray diffraction spectrum using CuKα characteristic X-rays as a charge generating material, 50 parts by weight of a bisphenol Z polycarbonate resin (viscosity average molecular weight: 50,000) as a binder resin, 11.5 parts by weight of the electron transporting materials shown in Table 1, 37 parts by weight of the hole transporting materials shown in Table 1, and 250 parts by weight of tetrahydrofuran and 250 parts by weight of toluene as a solvent is dispersed for 4 hours with a Dyno mill using glass beads having a diameter of 1 mmϕ to obtain a coating liquid B1 for forming a photosensitive layer.

A conductive substrate (made of aluminum) is installed in an ink jet film forming apparatus configured as shown in FIG. 3. The coating liquid A for forming a photosensitive layer is charged into a liquid droplet discharge portion 200B, and the coating liquid B1 for forming a photosensitive layer is charged into a liquid droplet discharge portion 200A (provided that a liquid droplet discharge portion 200C in FIG. 3 is not used). From the respective nozzles 202 provided in the liquid droplet discharge portions 200B and 200A, the charged coating liquids A and B1 for forming a photosensitive layer are jetted toward the conductive substrate under the following conditions.

Thereafter, drying is carried out at 140° C. for 30 minutes. Thus, a single-layer type photosensitive layer having a thickness of 30 μm is formed to thereby prepare an electrophotographic photoreceptor (1) of Example 1.

In the ink jet film forming apparatus, the coating liquid is transferred through a pump, a piezo element is provided with the liquid droplet discharge portion, the piezo element is vibrated to form liquid droplets, and the liquid droplets are continuously jetted. The configurations and application conditions of the apparatus are as follows. Further, the configurations of the apparatuses of the respective liquid droplet discharge portions are in common. In addition, in the respective example, the jetting conditions for jetting the coating liquid from the respective nozzles of the liquid droplet discharge portions 200B and 200A are as follows.

Inner diameter of the ink jet nozzle: 12.5 μm; array/number of the nozzles: series/7; distance between the nozzles: 0.5 mm; the distance between the nozzle and the drum: 1 mm; tilt angle: 80°; frequency of the piezo element: 75 kHz; frequency of a plunger pump: 5.58 Hz; and the rotational speed of the drum: 715 rpm

Examples 2 to 7 and Comparative Examples 3 and 4

In the same manner as in Example 1 except that photosensitive layers are formed by using coating liquids B2 to B6, and C3 for forming photosensitive layers, prepared by changing the amount of the charge generating materials, and the kinds of the electron transporting materials, the hole transporting materials, and the solvents according to Table 1, electrophotographic photoreceptors (2 to 7) of Examples 2 to 7, an electrophotographic photoreceptor (C3) of Comparative Example 3, and an electrophotographic photoreceptor (C4) of Comparative Example 4 are prepared.

Comparative Example 1

A mixture formed of 1.5 parts by weight of a Type V hydroxygallium phthalocyanine pigment having diffraction peaks at the positions at at least 7.3°, 16.0°, 24.9°, and 28.0° of Bragg angles (2θ±0.2°) in an X-ray diffraction spectrum using CuKα characteristic X-rays as a charge generating material, 50 parts by weight of a bisphenol Z polycarbonate resin (viscosity average molecular weight: 50,000) as a binder resin, 10 parts by weight of the electron transporting materials shown in Table 1, 37 parts by weight of the hole transporting materials shown in Table 1, and 250 parts by weight of tetrahydrofuran and 50 parts by weight of toluene as a solvent is dispersed for 4 hours with a Dyno mill using glass beads having a diameter of 1 mmϕ to obtain a coating liquid C1 for forming a photosensitive layer.

The coating liquid C1 for forming a photosensitive layer is coated on a conductive substrate (aluminum substrate) by a dipping coating method, and subjected to drying and curing at 140° C. for 30 minutes to form a single-layer type photosensitive layer having a thickness of 30 μm, thereby preparing an electrophotographic photoreceptor (C1) of Comparative Example 1.

Comparative Example 2

An electrophotographic photoreceptor (C2) of Comparative Example 2 is prepared in the same manner as in Comparative Example 1 except that a photosensitive layer is prepared by using a coating liquid C2 for forming a photosensitive layer prepared by changing the amount of the charge generating material.

Evaluations

The electrophotographic photoreceptors obtained in the respective Examples are evaluated by the following manners. The results thereof are shown in Tables.

Calculation of a/b

In the respective Examples, for the obtained photosensitive layers, according to the above-described methods, the value of Formula a/b representing the distribution of the charge generating materials in the film thickness of the photosensitive layer is calculated. The results are shown in Table 2.

Evaluation of Sensitivity of Photoreceptor

The sensitivity of the photoreceptor is evaluated as a half-reduction exposure amount when it is charged to +800 V. Specifically, the photoreceptor is charged to +800 V in an environment of 20° C. and 40% RH, using an electrostatic copying paper testing apparatus (Electrostatic analyzer EPA-8100, manufactured by Kawaguchi Electric Works), and then irradiated with monochromatic light with 800 nm obtained from light of a tungsten lamp using a monochromator so as to provide 1 μW/cm$^2$ on the surface of the photoreceptor.

Then, a potential V0 (V) of the photoreceptor surface immediately after charging, and a half-reduction exposure amount $E_{1/2}$ (μJ/cm$^2$) at which the surface potential became ½×V0 (V) by irradiation of the photoreceptor surface with light are measured.

In addition, as for the evaluation criteria of the sensitivity of the photoreceptor, when a half-reduction exposure amount of 0.2 μJ/cm$^2$ or less is obtained, it is evaluated that high sensitivity is obtained. The results are shown in Table 2.

A: 0.2 μJ/cm$^2$ or less

B: More than 0.2 μJ/cm$^2$

Evaluation of Chargeability of Photoreceptor

The chargeability of the photoreceptor is evaluated by an electrical conductivity σ [1/Ω·cm] determined by direct current IV measurement under a dark condition.

A measurement sample for chargeability evaluation is prepared by sputtering gold on the photoreceptor surface (a triplicate electrode area of 0.92 cm$^2$). By stepwise applying a voltage with a plus on the gold side and measuring the current value at that time, the electrical conductivity at 27 V/μm is calculated. The results are shown in Table 2.

Furthermore, as for the evaluation criteria for the chargeability of the photoreceptor, when σ is $1.0\times10^{-13}$ [1/Ω·cm] or less, it is evaluated that high chargeability is obtained.

A: $1.0\times10^{-13}$ [1/Ω·cm] or less

B: More than $1.0\times10^{-13}$ [1/Ω·cm]

TABLE 1

| | | | Coating liquid A | | | Coating liquid B (or coating liquid C) | | | | | | | |
|---|---|---|---|---|---|---|---|---|---|---|---|---|---|
| | | | | | | | Charge generating material | | Electron transporting material | | Hole transporting material | | |
| | Photoreceptor No. | Coating method | Hole transporting material Type | Hole transporting material Parts by weight | Solvent THF parts by weight | Coating liquid No. | Type | Parts by weight | Type | Parts by weight | Type | Parts by weight | Solvent |
| Example 1 | Photoreceptor 1 | IJ | HTM-1 | 40 | 250 | B1 | CGM-1 | 1.5 | ETM-1 | 10 | HTM-1 | 37 | THF/Tol |
| Example 2 | Photoreceptor 2 | IJ | HTM-1 | 40 | 250 | B2 | CGM-1 | 1.5 | ETM-2 | 10 | HTM-1 | 37 | THF/Tol |
| Example 3 | Photoreceptor 3 | IJ | HTM-1 | 40 | 250 | B3 | CGM-1 | 1.5 | ETM-3 | 10 | HTM-1 | 37 | THF/Tol |
| Example 4 | Photoreceptor 4 | IJ | HTM-2 | 40 | 250 | B4 | CGM-1 | 1.5 | ETM-2 | 10 | HTM-2 | 37 | THF/Tol |
| Example 5 | Photoreceptor 5 | IJ | HTM-2 | 40 | 250 | B5 | CGM-1 | 1.5 | ETM-2 | 10 | HTM-2 | 37 | CPN |
| Example 6 | Photoreceptor 6 | IJ | HTM-1 | 40 | 250 | B6 | CGM-1 | 4.5 | ETM-1 | 10 | HTM-1 | 37 | THF/Tol |
| Example 7 | Photoreceptor 7 | IJ | HTM-1 | 40 | 300 | B6 | CGM-1 | 4.5 | ETM-1 | 10 | HTM-1 | 37 | THF/Tol |
| Comparative Example 1 | Photoreceptor C1 | dip | — | — | 250 | C1 | CGM-1 | 1.5 | ETM-1 | 10 | HTM-1 | 37 | THF/Tol |
| Comparative Example 2 | Photoreceptor C2 | dip | — | — | 250 | C2 | CGM-1 | 2.0 | ETM-1 | 10 | HTM-1 | 37 | THF/Tol |
| Comparative Example 3 | Photoreceptor C3 | IJ | HTM-1 | 40 | 250 | C3 | CGM-1 | 6.0 | ETM-1 | 10 | HTM-1 | 37 | THF/Tol |
| Comparative Example 4 | Photoreceptor C4 | IJ | HTM-1 | 40 | 300 | C3 | CGM-1 | 6.0 | ETM-1 | 10 | HTM-1 | 37 | THF/Tol |

TABLE 2

| | | | Distribution of charge generating materials | | | | Sensitivity | | Chargeability | |
|---|---|---|---|---|---|---|---|---|---|---|
| | Photoreceptor No. | Coating method | Content of the entire photosensitive layer % by weight | a (n3 average) No./μm² | b (n3 average) No./μm² | a/b | $E_{1/2}$ [μJ/cm²] | Assessment | σ [1/Ω · cm] | Assessment |
| Example 1 | Photoreceptor 1 | IJ | 0.5 | 13 | 0.3 | 43 | 0.18 | A | $3.25 \times 10^{-14}$ | A |
| Example 2 | Photoreceptor 2 | IJ | 0.5 | 15 | 0.3 | 50 | 0.18 | A | $2.94 \times 10^{-14}$ | A |
| Example 3 | Photoreceptor 3 | IJ | 0.5 | 13 | 0 | 13/0 | 0.18 | A | $4.79 \times 10^{-14}$ | A |
| Example 4 | Photoreceptor 4 | IJ | 0.5 | 13 | 0.3 | 43 | 0.16 | A | $1.96 \times 10^{-14}$ | A |
| Example 5 | Photoreceptor 5 | IJ | 0.5 | 12 | 0 | 12/0 | 0.16 | A | $1.96 \times 10^{-14}$ | A |
| Example 6 | Photoreceptor 6 | IJ | 1.5 | 51 | 1 | 51 | 0.12 | A | $6.60 \times 10^{-14}$ | A |
| Example 7 | Photoreceptor 7 | IJ | 1.5 | 51 | 1.7 | 30 | 0.12 | A | $6.60 \times 10^{-14}$ | A |
| Comparative Example 1 | Photoreceptor C1 | Dip | 1.5 | 13 | 13 | 1 | 0.25 | B | $1.63 \times 10^{-13}$ | B |
| Comparative Example 2 | Photoreceptor C2 | Dip | 2.0 | 17 | 17 | 1 | 0.19 | A | $5.20 \times 10^{-13}$ | B |
| Comparative Example 3 | Photoreceptor C3 | IJ | 2.0 | 50 | 0.3 | 167 | 0.14 | A | $3.27 \times 10^{-13}$ | B |
| Comparative Example 4 | Photoreceptor C4 | IJ | 2.0 | 46 | 1.3 | 35 | 0.13 | A | $3.27 \times 10^{-13}$ | B |

From the above results, it may be seen that in Examples, good results for the evaluations of the sensitivity and the chargeability of the electrophotographic photoreceptor are obtained, as compared with Comparative Examples.

Details on the abbreviations in Tables 1 and 2 are shown below.

"IJ": Ink jet coating method

"CGM-1": Type V hydroxygallium phthalocyanine pigment having diffraction peaks at the positions at at least 7.3°, 16.0°, 24.9°, and 28.0° of Bragg angles (2θ±0.2°) in an X-ray diffraction spectrum using CuKα characteristic X-rays "ETM-1": 3, 3'-Di-tert-pentyl-dinaphthoquinone "ETM-2": 3,3',5, 5'-Tetra-ter t-butyl-4, 4'-diphenoquinone "ETM-3": Benzyl 9-dicyanomethylene-9-fluorenone 2-carboxylate "HTM-1": N,N'-Diphenyl-N,N'-bis(3-methylphenyl)-1, 1'-biphenyl-4, 4'-diamine "HTM-2": 4-(2,2-Diphenylethenyl)-N,N'-bis(4-methylphenyl)benzenamine "THF": Tetrahydrofuran "Tol": Toluene "CPN": Cyclopentanone The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a single-layer type photosensitive layer that is provided on the conductive substrate and contains a binder resin, a charge generating material, a hole transporting material, and an electron transporting material, wherein a content of the charge generating material in the photosensitive layer is 0.5% by weight or more and less than 2.0% by weight and the charge generating material satisfies the following expression (1) with respect to a distribution of the charge generating material in the film thickness direction of the photosensitive layer:

$$30 \leq a/b \qquad \text{Expression (1);}$$

wherein a represents a number of the charge generating material per unit cross-sectional area in a region ranging from a surface side of a film thickness of the photosensitive layer to a point corresponding to ⅓ of the film thickness, and b represents a number of the charge generating material per unit cross-sectional area in a region ranging from a conductive substrate side of a film thickness of the photosensitive layer to a position corresponding to ⅔ of the film thickness, provided that a case where b is 0 is also included.

2. The electrophotographic photoreceptor according to claim 1, wherein b is 0.

3. The electrophotographic photoreceptor according to claim 1, wherein b is more than 0.

4. The electrophotographic photoreceptor according to claim 1, wherein the content of the charge generating materials is from 2% by weight to 10% by weight with respect to the binder resin.

5. The electrophotographic photoreceptor according to claim 1, wherein the content of the charge generating materials is from 0.7% by weight to 1.7% by weight with respect to the entire photosensitive layer.

6. The electrophotographic photoreceptor according to claim 1, wherein the content of the charge generating materials is from 0.9% by weight to 1.5% by weight with respect to the entire photosensitive layer.

7. A process cartridge comprising:

the electrophotographic photoreceptor according to claim 1, wherein the process cartridge is detachable from an image forming apparatus.

8. An image forming apparatus comprising:

the electrophotographic photoreceptor according to claim 1;

a charging unit that charges the surface of the electrophotographic photoreceptor;

an electrostatic latent image forming unit that forms an electrostatic latent image on the surface of the charged electrophotographic photoreceptor;

a developing unit that develops the electrostatic latent image formed on the surface of the electrophotographic photoreceptor by a developer including a toner to form a toner image; and a transfer unit that transfers the toner image to the surface of a recording medium.

* * * * *